US006027004A

United States Patent [19]

Ramella et al.

[11] Patent Number: 6,027,004

[45] **Date of Patent: *Feb. 22, 2000**

[54] SETTING TOOL FOR DRIVING FASTENING ELEMENTS INTO HARD BASE MATERIALS

[75] Inventors: Angelo Ramella, Frauenfeld; Hans Tischhauser, Zuzwil; Guido Sutter, Schwarzenbach, all of Switzerland

[73] Assignee: Hilti Aktiengesellschaft, Schaan, Liechtenstein

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,760

[22] Filed: Jul. 1, 1997

[30] Foreign Application Priority Data

Jul. 12, 1996 [DE] Germany ..... 196 28 170

[51] Int. Cl.[7] ..... B25C 5/06

[52] U.S. Cl. ..... 227/136; 227/138; 227/119; 81/434

[58] Field of Search ..... 227/16, 13, 5, 227/136, 119, 135, 138; 81/434

[56] References Cited

U.S. PATENT DOCUMENTS

| | | | |
|---|---|---|---|
| 2,770,269 | 11/1956 | Austin | 81/434 |
| 3,910,324 | 10/1975 | Nasiatka | 227/136 |
| 4,062,389 | 12/1977 | Lejdegard | 227/136 |
| 4,146,071 | 3/1979 | Mueller | 227/136 |
| 4,404,877 | 9/1983 | Mizuno | 227/136 |
| 4,674,367 | 6/1987 | Aab | 81/434 |
| 4,930,673 | 6/1990 | Pfister | 227/136 |
| 5,027,679 | 7/1991 | Kawashima | 81/434 |
| 5,339,983 | 8/1994 | Caple | 227/138 |
| 5,452,630 | 9/1995 | Haas | 81/434 |

*Primary Examiner*—Peter Vo
*Assistant Examiner*—James P. Calve
*Attorney, Agent, or Firm*—Brown & Wood, LLP

[57] ABSTRACT

A setting tool for driving fastening elements (12) includes a transport device (7) for strip-shaped magazines (11) containing the fastening elements (12) each spaced apart at a dimension (A) from one another. Pivotal transport levers (13, 22) are arranged within the transport device (7) for moving the magazines (11). One of the transport levers (22) is displaceable by a distance corresponding at least to the transporting path of the other transport lever (13). With the transport device (7) it is possible to insure different transport paths.

7 Claims, 2 Drawing Sheets

2
26
28
27
24
25
22
20
19
L
17
18
21
12
15
23
13
10
8
6
32
14
A
30
16
12
29
11
7
12
9
11
31

SETTING TOOL FOR DRIVING FASTENING ELEMENTS INTO HARD BASE MATERIALS

BACKGROUND OF THE INVENTION

The present invention is directed to a setting device for driving fastening elements into a base material and includes a transport device for elongated strip-shaped magazines containing fastening elements spaced apart for a given dimension in the elongated direction. The setting tool has a housing. The transport device includes an attachment that is displaceable relative to the housing parallel to the setting direction. The attachment has a guide channel for the magazines holding the fastening elements. A two-armed transport lever is positioned within the attachment and is arranged to be pivoted. The two-armed transport lever has first lever arm and a second lever arm with a pivotal pawl connected to the first lever arm and arranged to cooperate with the magazine within the guide channel. The second lever arm cooperates with a stop face on the housing.

A setting tool with a transport device for strip-shaped magazines in which fastening elements are spaced apart at a distance from one another is disclosed in U.S. Pat. No. 5,341,706. The transport device has an attachment displaceable relative to the housing of the setting tool and parallel to the setting direction, and the attachment contains a guide channel and a pivotal two-arm transport lever. A pivotal pawl cooperates with a magazine positioned in the guide channel and is located at a first lever arm of the two-armed transport lever. The second lever arm cooperates with a control cam of the setting tool housing. The two-armed transport lever pivots in the transporting direction when the setting tool is pressed against a base material and the attachment moves towards the housing.

The transporting arrangement of this known setting tool is designed so that it is capable only of insuring a unique, uniform, predetermined transporting path. It is not possible to alter this transporting path as determined by its design.

SUMMARY OF THE INVENTION

The primary object of the present invention is to provide a transport device for a setting tool of the type mentioned above affording different transporting paths without manual intervention.

In accordance with the present invention, a transport device for a setting tool is provided with a pivotal one-armed transport lever displaceable against the force of a spring in the setting direction and arranged in an attachment of the transport device between a stop face on the setting tool housing and a second lever-arm of the two-armed transport lever which is displaceable for a distance corresponding at least to the transporting path of the two-armed transport lever.

The one-armed transport lever enables the transport of additional magazines inserted into the guide channel following a leading magazine. If only a first or leading magazine is in the guide channel, the movement of such magazine is effected by the two-armed transport lever. If another magazine is located in the guide channel following the first magazine, the transport of both magazines is effected by the one-armed transport lever as soon as it cooperates with the first fastening element of the trailing magazine.

Particularly when transporting strip-shaped magazines with insertion guides at their end regions in the form of relatively long surfaces tapering inwardly toward the free ends of the magazine, the problem can develop that the distance between the last fastening element of the first or leading magazine and the first fastening element of the trailing or following magazine is greater than the transporting path of the two-armed transport lever. Accordingly, the transport device must have different transporting paths.

So that the one-armed transport lever can cooperate with the first fastening element of the following magazine, the one-armed transport lever must have a greater transporting path than the two-armed transport lever. Therefore, a transmission element is preferably arranged between the one-armed transport lever and the two-armed transport lever with the transmission element being displaceable relative to at least one of the two transport levers by a distance corresponding at least to the transporting path of the two-armed transport lever.

The different transporting paths of the two transport levers are achieved by the transmission element preferably formed as a slide with a first end region connected to one of the transport levers and a second end region with a guide opening formed as an elongated hole penetrated by a stop of the other transport lever.

A compact construction of the transport device in the region of the second transport lever is achieved in that the transmission element is advantageously connected with the two-armed transport lever.

When two strip-shaped magazines are located in the guide channel, both magazines are transported therein by a distance corresponding to the transporting path of the two-armed transport lever. When the contact pressing path of the setting tool is greater than the transporting path of the second transport lever, the excess contact pressing distance must be compensated by the transport device. Accordingly, a transport arm with a contact surface is preferably arranged between the one-armed transport lever and the stop face of the housing with the transport arm being displaceable relative to the one-armed transport lever by a distance which corresponds at least to the transporting path of the two-armed transport lever.

To assure that the spring located between the one-arm transport lever and the attachment can compress before the other spring arranged between the transport arm and the one-armed transport lever, the spring force of the other spring is selected greater than the spring force of the spring between the one-arm transport lever and the attachment.

If the setting device is lifted from the base material, for instance, after a contact pressing step, without driving a fastening element located in the setting position into the base material, then the magazines in the guide channel cannot be displaced in the transporting direction during a subsequent contact pressing step, whereby the contact pressing paths transmitted from a stop face on the housing to the transport device must be compensated in its entirety without displacing the transport levers. At least a portion of the contact pressing path is compensated by means of the contact surface which is displaceable in the setting direction relative to the transporting arm by a distance corresponding at least to the transporting path of the two-armed transport lever.

For example, if the contact pressing path of the setting tool corresponds to twice the transporting path of the two-armed lever, half of the contact pressing path between the transporting arm and the one-armed transport lever is compensated.

To insure that the spring arranged between the transport arm and the one-armed transport lever can compress before the other spring cooperating with the contact surface, the spring force of the other spring is advisably greater than the spring force of the spring between the transport arm and the one-armed transport lever.

To provide a trouble-free transport of the magazine in the guide channel, the transporting path of the two-armed transport lever preferably corresponds to the distance between two adjacent fastening elements arranged in the strip-shaped magazine.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there are illustrated and described a preferred embodiment of the invention.

DETAILED DESCRIPTION OF THE INVENTION

Figure 1:
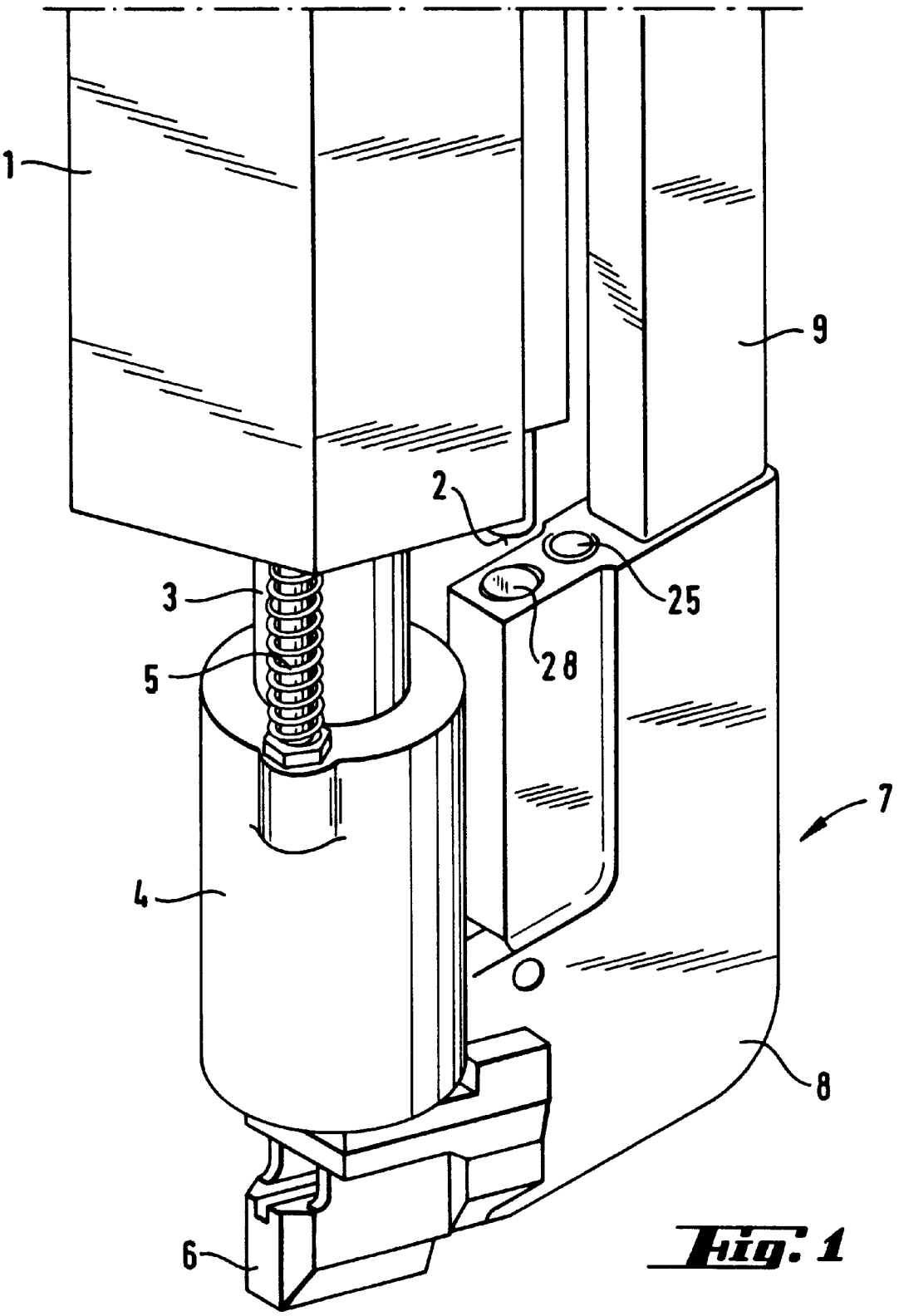
FIG. 1 is an elevational view of the leading end region of a setting tool embodying the present invention.

A setting tool, shown schematically in FIG. 1, has a housing 1 with a guide tube 3 connected to it and extending downwardly in the setting direction of the tool. A cylindrical guide part 4 encircles the guide tube and is displaceable opposite to the setting direction against the force of a positioning spring 5 extending between the housing 1 and the cylindrical guide part 4. Such displacement is identified as the contact pressing path. A stand plate 6 is located at the end face of the guide part 4, facing in the setting direction, and a transport device 7 is secured to the stand plate. The guide tube 3, cylindrical part 4 and stand plate 6 form part of a first means. The transport device 7 is actuated by means of a stop surface 2 shown more completely in FIG. 2, which projects in the setting direction from the housing 1 and presses against a contact surface 28 located within the transport device 7, when the setting tool is pressed against a base material, not shown. In such a pressing operation, the transport device 7, the stand plate 6 and the cylindrical guide part are displaced toward the housing 1 of the setting tool over the contact pressing path. An upper free end of a guide shaft 25 projects out of an attachment 8 of the first transport device 7, and a transport arm 26 located within the attachment is displaceable along the guide shaft 25.

Figure 2:
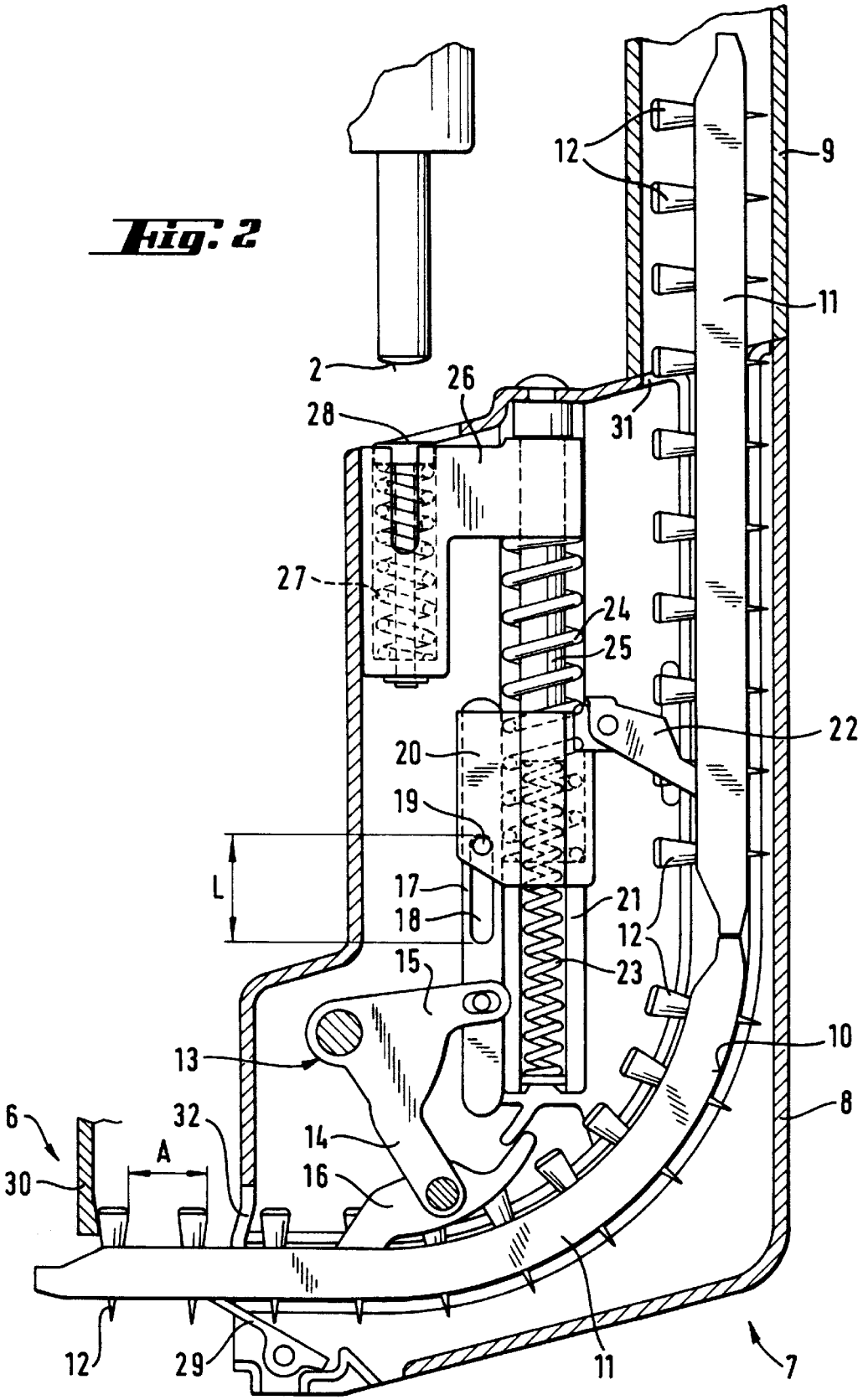
FIG. 2 is a sectional view extending in the setting direction of a transport device for the setting tool shown in FIG. 1.

The transport device 7, shown in FIG. 2, includes the attachment 8 with an upper inlet opening 31 and a lower outlet opening 32. In the region of the outlet opening 32, the attachment 8 is detachably arranged at the stand plate 6 as shown in FIG. 1. A guide channel 10 extends within the attachment 8 from the inlet opening 31 substantially parallel to the setting direction of the setting tool and in the lower end of the attachment, as viewed in FIG. 2, it changes direction so that in the region of outlet opening 32 it extends substantially perpendicularly to the setting direction of the setting tool.

Guide channel 10 serves to receive elongated strip-shaped magazines 11 containing a plurality of pin-shaped fastening elements 12 spaced apart from one another at a dimension A. At the ends of the magazines 11 insertion guides in the form of relatively long surfaces inclined inwardly towards the ends of the magazines 11 aid in the insertion of the magazines into the guide channel 10. In the illustrated embodiment, the dimension between a free end of the magazine 11 and the adjacent fastening element 12 is equal to the dimension A between two adjacent fastening elements 12 mounted in the magazine.

Within the attachment 8 in the region of the outlet opening 32, a two-armed transport lever 13 is pivotally mounted. As viewed in FIG. 2, the two-armed transport lever 13 has a first lever arm 14 extending generally downwardly from the pivot point and a second lever arm 15 extending generally horizontally from the pivot point. A pivotal pawl 16 cooperating with the strip-shaped magazine or with one of the fastening elements 12 is located at the lower end of the first lever arm 14. One end region of pawl 16 cooperates with the magazine 11 or fastening element 12 and the other end is supported at a control cam 33 of the attachment 8.

A slide-like transmission element 17 extending parallel to the setting direction is located within the attachment 8 and has an elongated guide opening or hole 18 penetrated by a stop 19 of a guide block 20. Below the guide opening 18, the transmission element 17 is engaged by the second lever arm 15. The guide block 20 is displaceable along a guide member 21 of the attachment 8 in the setting direction against the force of a one spring 23 supported in the attachment 8. A pivotal, first-armed transport lever 22 is pivotally secured at an upper end region of the guide block closer to the inlet opening 31.

The guide shaft 25 extending parallel to the setting direction extends upwardly from the guide block toward the housing 1 note FIG. 1. Guide shaft 25 extends partially into the guide block 20, it is secured to the attachment 8, and is laterally enclosed by a second spring 24. The transport arm 26 is mounted on the guide shaft 25 and is supported on the guide block 20 by the second spring 24 so that it can be displaced along the guide shaft 25. The contact surface 28 is located within the transport arm 26 and is supported in the setting direction in the transport arm by a third spring 27.

An extension 9 in which additional strip-shaped magazines 11 can be arranged one after the other extends upwardly from the inlet opening 31 of the attachment 8 opposite to the setting direction.

The operation of the transport device 7, when a magazine 11 is located in the guide channel 10, is described as follows.

To be able to feed a fastening element 12 to the setting end region of the setting tool, adjacent stand plate 6, at least one strip-shaped magazine 11 must be inserted into the guide channel 10 of the attachment 8. The strip-shaped magazine 11 is inserted manually until a leading or first fastening element 12 arrives in the working region of the one-armed transport lever 22. Further transport of the magazine within the guide channel is effected by a contact pressing movement of the setting tool with the housing 1 and the transport device 7 moving toward one another along the contact pressing distance. After the magazine 11 is inserted into the guide channel 10 it is necessary to press the setting device against the base material a number of times until the leading fastening element 12 has reached the setting position at the stop edge 30 of the stand plate 6, shown in FIG. 2. With each contact pressing movement or step, the stop face 2 of the housing 1 presses against the contact surface 28 of the first transport arm 26 and the transport arm is displaced in the setting direction along the guide shaft 25. A second means effects transfer to displacement from the stop face 2 to the contact surface 38 and then to the one-armed transport lever 22 and the two-armed transport lever 13. The movement of the transport arm 26 is transmitted to the guide block 20 via the second spring 24 without any compression of the second spring. In such operation, the first spring 23, located between the guide block 20 and the attachment 8, is pretensioned. The spring force of the first spring 23 is smaller than the spring force of the second spring 24. The movement of the guide block 20 causes the stop 19 to move through the guide opening 18 of the transmission element 17 connected to the second lever arm 15 of the two-armed transport lever 13. Note that the guide opening 18 is formed as an elongated hole. In the embodiment illustrated in FIG. 2, the length L of the guide opening 18 corresponds to the diameter of the stop 19 and the dimension A between two adjacent fastening elements 12 in the magazine 11. Since the stop 19 is displaced freely through the guide opening 18, the two-armed transport lever is pivoted only when the stop 19 strikes the lower end of the guide opening. So that the two-arm transport lever can be pivoted through a distance corresponding to the dimension A to move the fastening element 12 towards the stop edge 30 of the stand plate 6, it is necessary that the contact pressing distance in this embodiment corresponds at least to twice the dimension A.

When two magazines 11 are located in the guide channel 10, the movement of the magazines is effected as follows.

With each contact pressing step, the stop face 2 of the housing 1 presses against the contact surface 28 located in the transport arm 26. The movement of the stop surface 2 is transmitted to the transport arm 26 via the third spring 27 with the transport arm moving along the guide shaft 25 in the setting direction. The transmission of the movement of the transport arm 26 to the guide block 20 and accordingly to the one-armed transport lever 22 is effected by the second spring 24 until a fastening element 12 again strikes the stop edge 30 of the stand plate 6. Since the contact pressing path of the setting tool is greater than the path over which the fastening element is moved, the compensation of the remaining contact pressing path is effected and the second spring 24 can be compressed whereby the transport arm 26 can be displaced toward the guide block 20.

The movement of both magazines 11 is effected by the one-armed transport lever 22 mounted at the guide block 20. When the last fastening element 12 of the leading magazine 11 is driven, the following magazine is transported during the subsequent contact pressing step not by a distance corresponding to the dimension A, but rather by the distance given by the distance between the free end of the two magazines and the following fastening elements 12.

A pivotal locking pawl 29 at the lower end of the attachment 8 as viewed in FIG. 2, prevents displacement of the magazine 11 opposite to the transporting direction.

If the setting tool is lifted from the base material after a contact pressing step, but without a fastening element 12 located in the setting position being driven into the base material, then the magazines 11 in the guide channel 10 can no longer be displaced in the transporting direction during a subsequent contact pressing step, since one of the fastening elements 12 is located in the setting position. As a consequence, the second spring 24 and the third spring 27 are compressed for a distance corresponding to the dimension A. In this manner, the entire pressing path acting on the transport device is compensated.

While specific embodiments of the invention have been shown and described in detail to illustrate the inventive principles, it will be understood that the invention may be embodied otherwise without departing from such principles.

What is claimed is:

1. A setting tool for driving fasteners (12) in a setting direction into a base material includes a transport device (7) for long strip-shaped magazines (11) having an elongated direction and securing said fastening elements (12) each spaced apart in the magazine in the elongated direction by a dimension (A), said setting tool comprises a housing (1) extending in the setting direction, said housing having a first end facing in the setting direction, first means (3, 4, 6) extending in the setting direction from the first end of said housing (1), for effecting displacement of said housing (1) relative to said transport device 7, said first means terminating in a stand plate (6) spaced in the setting direction from said first end of said housing (1), said stand plate located in the path of a fastener to be driven into the base material and having a stop edge for aligning said fasteners prior to said fasteners being driven, said transport device (7) comprises an attachment (8) being secured to said stand plate (6) and extending therefrom opposite to the setting direction and being displaceable relative to said housing (1) parallel to the setting direction, a guide channel (10) for said magazines (11) positioned within said attachment (8), a unitary two-arm transport lever (13) positioned within said attachment (8) adjacent to and spaced from said stand plate (6) and arranged to be pivoted about a pivot point extending transversely of the setting direction within said attachment, said two-arm transport lever (13) being pivotal along a transporting path corresponding to the dimension (A) and having a first lever arm (14) and a second lever arm (15) spaced angularly apart and interconnected at said pivot point, a pivotal pawl (16) connected to said first lever arm (14) at a location spaced from said pivot point and arranged to cooperate with said magazine for movement toward said stand plate (6) within said guide channel (10), second means within said attachment for interconnecting said second lever arm (15) with a stop surface (2) in said housing adjacent to the first end thereof and arranged to press against a contact surface (28) in said transport device (7) for pivotally displacing said two-arm transport lever (13), said second means within said attachment including said contact surface (28), said second means including a pivotal one-arm transport lever (22) located within said attachment (8) between said contact surface (28) and said second lever arm (15) spaced opposite to the setting direction from said second lever arm (15) and being displaceable therein in the setting direction against the force of a first spring (23) of said second means and being displaceable by a distance corresponding at least to said transporting path of said two-armed transport lever (13).

2. Setting tool, as set forth in claim 1, wherein said second means includes a rectilinear transmission element (17) extending parallel to the setting direction and positioned between said one-armed transport lever (22) and said second lever arm (15) of said two-armed transport lever (13), said transmission element (17) being displaceable relative to at least one of said two-armed transport lever (13) and said one-arm transport lever (22) by a distance corresponding at least to the transporting path of said two-armed transport lever (13).

3. Setting tool, as set forth in claim 2, wherein said transmission element (17) is formed of a slide with a first and a second end region whereby the first end region is connected with said one-armed transport lever (13, 22) and the second end region has an elongated rectilinear guide opening (18) in which a stop (19) of said second means is positioned, and said transmission element is connected to said two-armed transport lever (13, 22).

4. Setting tool, as set forth in one of claims 1, 2 and 3, wherein said second means comprises a first transport arm (26) including said contact surface (28) and is arranged between said one-armed transport lever (22) and said stop surface (2) of said housing (1), said first transport arm (26) being displaceable in the setting direction relative to said one-armed transport lever (13) by a distance corresponding at least to the transporting path of said two-armed transport lever (13).

5. Setting tool, as set forth in claim 4, wherein said first transport arm (26) is supported at said one-armed transport lever (22) by a second spring (24) having a spring force greater than the spring force of said first spring (23).

6. Setting tool as set forth in claim 4, wherein said contact surface (28) of said first transport arm (26) being displaceable in the setting direction relative to said one-armed transporting element (22) by a distance corresponding at least to the transporting path of said two-armed transport lever (13).

7. Setting tool, as set forth in claim 6, wherein said contact surface (28) of said first transport arm (26) being supported in the setting direction by a third spring (27) having a spring force greater than the spring force of said second spring (24).

* * * * *